United States Patent [19]

Niskanen

[11] Patent Number: 4,711,405

[45] Date of Patent: Dec. 8, 1987

[54] METHOD AND APPARATUS FOR FIXING AN END OF A WEB ON A CORE TUBE IN A WEB REELING MACHINE

[75] Inventor: Heikki Niskanen, Järvenpää, Finland

[73] Assignee: Oy Wartsila AB, Finland

[21] Appl. No.: 800,977

[22] Filed: Nov. 22, 1985

[30] Foreign Application Priority Data

Nov. 27, 1984 [FI] Finland ..... 84 4653

[51] Int. Cl.[4] ..... B65H 18/20; B65H 19/28

[52] U.S. Cl. ..... 242/66

[58] Field of Search ..... 242/66

[56] References Cited

U.S. PATENT DOCUMENTS 2,537,588 1/1951 Husson ..... 242/66 X 4,103,840 8/1978 Dowd ..... 242/66 X 4,572,451 2/1986 Ikeda et al. ..... 242/66 X

*Primary Examiner*—Stuart S. Levy

*Assistant Examiner*—Joseph J. Hail, III

*Attorney, Agent, or Firm*—Steinberg & Raskin

[57] ABSTRACT

Method and apparatus for fixing the end of a web on a core tube in a web reeling machine which includes a pair of spaced carrier rolls on which the core tube is supported. Adhesive agent is applied on the core tube, supported on the carrier rolls, from below and between the carrier rolls. The adhesive agent is conducted onto the core tube by moving an applicator device in the transverse cross-machine direction, beginning at the underside of the core tube at one transverse end of the reeling machine. The core tube may be urged against the carrier rolls by a depressor roll or the like during application of the adhesive agent on the core tube.

8 Claims, 2 Drawing Figures

METHOD AND APPARATUS FOR FIXING AN END OF A WEB ON A CORE TUBE IN A WEB REELING MACHINE

BACKGROUND OF THE INVENTION

This invention relates generally to web reeling methods and apparatus and, more particularly, to methods and apparatus for fixing the end of a web to a core tube in web reeling apparatus.

Methods and apparatus are known for fixing the end of a web to a core tube in a reeling machine wherein adhesive agent, such as glue or the like, is applied to the core tube.

In reeling machines such, for example, as longitudinal slicers, it is necessary to use glue or other suitable adhesive agent to fix the web end on the core tube when a new web is introduced. A problem is generally encountered, however, in that some of the glue is deposited on the carrier rolls of the longitudinal slicer during the web changing operation which causes problems during operation.

Apparatus for applying glue to a core tube is disclosed in Finnish publicizing print No. 63919. In accordance with the apparatus disclosed in this publication, glue is applied on the core tube before the core tube is introduced between the carrier rolls. A drawback inherent in this arrangement is that a high degree of accuracy is required in situating the core tube between the carrier rolls, particularly in the case where the size of the core tube changes. Another disadvantage of this apparatus is that the carrier rolls will have glue deposited on them if the end of the web that is being fixed is not in place between one of the two carrier rolls and the core tube.

SUMMARY OF THE INVENTION

Accordingly, one object of the present invention is to provide new and improved methods and apparatus for fixing an end of a web on a core tube in a web reeling machine which includes a pair of spaced carrier rolls.

Another object of the present invention is to provide new and improved methods and apparatus for fixing an end of the web on a core tube in a web reeling machine which avoid detrimental deposition of the adhesive agent onto the carrier rolls.

Still another object of the present invention is to provide new and improved methods and apparatus for fixing an end of the web on a core tube which enable the web changing operation to be carried out in a more reliable manner than has been possible heretofore and which does not increase the time required for the web changing operation.

Briefly, in accordance with the present invention, these and other objects are attained by providing an arrangement wherein after the core tube is supported on the spaced carrier rolls of the web reeling machine, adhesive agent is applied to the core tube from below and between the carrier rolls.

In the illustrated embodiment, the adhesive agent is applied to the core tube in a transverse machine direction beginning at the underside of the core tube at a transverse end region thereof. Means may be provided for urging the core tube against the carrier rolls during the application of the adhesive agent.

The method and apparatus of the invention enable the adhesive agent to be applied to the core tube in a manner such that none of the adhesive agent will be deposited onto or will adhere to the carrier rolls of the web reeling machine which is an important advantage relative to conventional arrangements. Moreover, a relativey short web changing time is maintained when using the method and apparatus of the invention.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
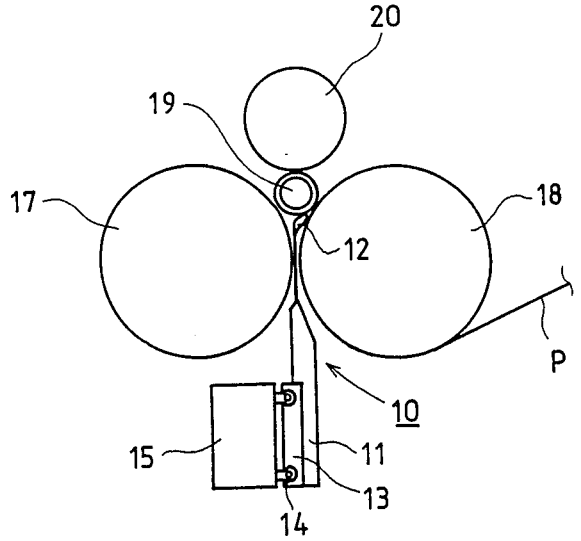
FIG. 1 is a schematic side elevation view of apparatus in accordance with the invention for performing a method in accordance with the invention.

Referring now to the drawings wherein like reference characters designate identical or corresponding parts throughout the several views, a web reeling machine for use with apparatus for fixing the end of a web P to a core tube 19 is illustrated. The web reeling machine includes a pair of spaced parallel carrier rolls 17 and 18 adapted to support the core tube 19 around which the web P is to be wound. Apparatus for fixing the end of the web P on the core tube 19 is generally designated 10.

The web end fixing apparatus 10 includes a body part 11 terminating at an applicator head 12, the body part 11 extending from a frame 13. In accordance with the basic principle of the invention, the apparatus 10 is situated below the carrier rolls 17 and 18 of the reeling machine, which may constitute a longitudinal slicer, the body part 11 and applicator head 12 extending between them. The applicator 12 is disposed to apply a line of adhesive agent on the underside of the core tube 19 to which the end of the paper web P that is being changed is subsequently caused to adhere.

Figure 2:
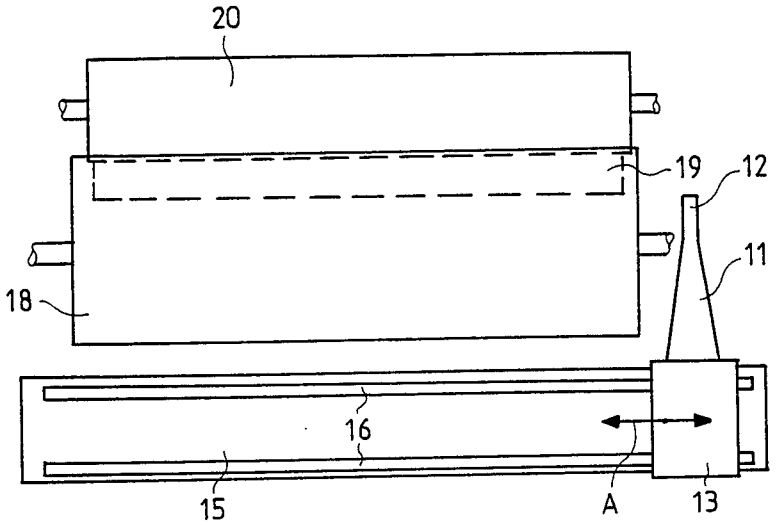
FIG. 2 is a front elevation view of the apparatus shown in FIG. 1.

In the embodiment of the invention shown in FIGS. 1 and 2, the frame 13 for body part 11 is provided with rollers 14 or the like which are arranged to traverse slide rails 16 on a stationary slide member 15. It is therefore seen that in accordance with the illustrated embodiment, the adhesive agent applicator is arranged to be movable between the carrier rolls 17 and 18 in the transverse cross-machine direction of the reeling machine. The frame 13, along with the body part 11 and applicator head 12, will thus move in the direction of arrow A of FIG. 2 whereupon a line of adhesive agent will be applied to the underside of the core tube 19 beginning at one transverse end of the longitudinal slicer and moving transversely to apply a uniform line of adhesive agent to the underside of the core tube 19.

In certain applications, the applicator head 12 is urged during the application of the adhesive agent with too great a force, the core tube 19 will tend to be lifted up from its position between the carrier rolls 17 and 18. This problem is overcome by providing a depressor roll 20 over the core tube 19 prior to initiation of the application of the adhesive agent to the core tube 19. Conventional means for urging the depressor tube 20 against the core tube 19 are of course provided. Although the provision of a depressor roll 20 will necessarily slightly increase the time for changing a web, the advantages obtained through the use of a depressor roll 20 will outweigh any minimal loss of time.

The apparatus of the invention operates in the following manner. When it is desired to change webs, a completed reel is removed from the carrier roll 17 and 18 and the web P cut. A new core tube 19 is introduced between the carrier rolls 17 and 18 to be supported thereby. The adhesive agent applicating means 10 is then set in motion as indicated by arrow A causing the applicator head 12 to apply a line of the adhesive agent on the underside of the core tube 19. It is noted that no adhesive agent will be deposited on the carrier roll 17 and 18 since the core tube 19 cannot move with respect to the carrier rolls 17 and 18 during such application.

In a case where the paper web P to be fixed to the core tube 19 is for some reason not in place between one carrier roll and the core tube 19, the reeling operation is not initiated so that the adhesive agent will not contaminate the carrier rolls 17 and 18.

The method and apparatus of the invention can also be applied in affixing the end of a web on a completed roll prior to the roll being removed from the carrier rolls 17 and 18.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a web reeling machine including a pair of spaced carrier rolls adapted to support a core tube around which the web is to be wound, a method for fixing an end of the web on the core tube, comprising the steps of:

supporting the core tube on the pair of spaced carrier rolls so that an underside of the core tube faces downwardly toward an inter-roll space defined between the spaced carrier rolls, applying adhesive agent directly into contact with the underside of the core tube by means of direct contact of an adhesive agent applicator that extends from below the carrier rolls and that has an applicator head situated in the inter-roll space between the carrier rolls; and fixing the end of the web to the core tube at a location thereon to which the adhesive agent has been applied.

2. The method of claim 1 wherein said adhesive agent applying step includes the steps of applying the adhesive agent directly into contact with the underside of the core tube in the form of a continuous, uniform line by moving the adhesive agent applicator in a transverse machine direction so that the application of the adhesive agent is initiated substantially at a transverse end region of the core tube.

3. The method of claim 1 including the further step of urging the core tube against the carrier rolls during said adhesive agent applying step.

4. A web reeling machine comprising:

a pair of spaced carrier rolls adapted to support a core tube around which the web is to be wound so that an underside of the core tube faces downwardly toward an inter-roll space defined between the spaced carrier rolls;

means for applying adhesive agent directly into contact with the underside of the core tube, said adhesive agent applying means including an adhesive agent applicator comprising a body part that extends from below said carrier rolls and an applicator head situated in said inter-roll space between said carrier rolls and disposed to directly contact the core tube.

5. The combination of claim 4 wherein said adhesive agent applying means comprise means for applying the adhesive agent directly into contact with the underside of the core tube in the form of a continuous, uniform line, said adhesive agent applying means further including mounting means for moving said adhesive agent applicator in a transverse machine direction.

6. The combination of claim 5 further including depressor roll means for urging the core tube against said carrier rolls during application of said adhesive agent.

7. The combination of claim 4 further including depressor roll means for urging the core tube against said carrier rolls during application of said adhesive agent.

8. The combination of claim 4 wherein said adhesive agent applying means further comprise a frame situated below said carrier rolls from which said body part extends and a slide member to which said frame is coupled for sliding movement in a transverse machine direction.

* * * * *